United States Patent [19]

Cameron

[11] 4,402,668

[45] Sep. 6, 1983

[54] CONVEYOR FURNACE

[75] Inventor: Ian D. Cameron, Dundee, Scotland

[73] Assignee: Delta Capillary Products Limited, Dundee, Great Britain

[21] Appl. No.: 240,303

[22] Filed: Mar. 10, 1981

[51] Int. Cl.[3] ..... F27B 9/16

[52] U.S. Cl. ..... 432/138; 414/151; 432/230

[58] Field of Search ..... 432/138, 230; 414/151; 198/803

[56] References Cited

U.S. PATENT DOCUMENTS

| | | | |
|---|---|---|---|
| 1,225,172 | 5/1917 | Privett | 414/151 |
| 1,583,974 | 5/1926 | Honigmann | 432/138 |
| 1,742,646 | 1/1930 | Buysse | 432/138 |

FOREIGN PATENT DOCUMENTS

| | | | |
|---|---|---|---|
| 961248 | 4/1957 | Fed. Rep. of Germany | 198/803 |
| 132578 | 10/1978 | Fed. Rep. of Germany | 198/803 |

*Primary Examiner*—John J. Camby

*Attorney, Agent, or Firm*—Buell, Blenko, Ziesenheim & Beck

[57] ABSTRACT

A conveyor furnace for heat treating a regular succession of articles consists of a circular carrier mounted for rotation about an upright axis below a fixed guide of open coiled spiral configuration and fixed radiant heaters directed through parts of the guide. A feed tube delivers the articles to an inner part of the guide on to the carrier whereon they are carried in sliding engagement with the guide, around and progressively outwards towards a discharge point. While on the carrier, the articles are heated by the heater. The furnace is compact, economical in operation and permits of relatively simple and reliable construction.

4 Claims, 5 Drawing Figures

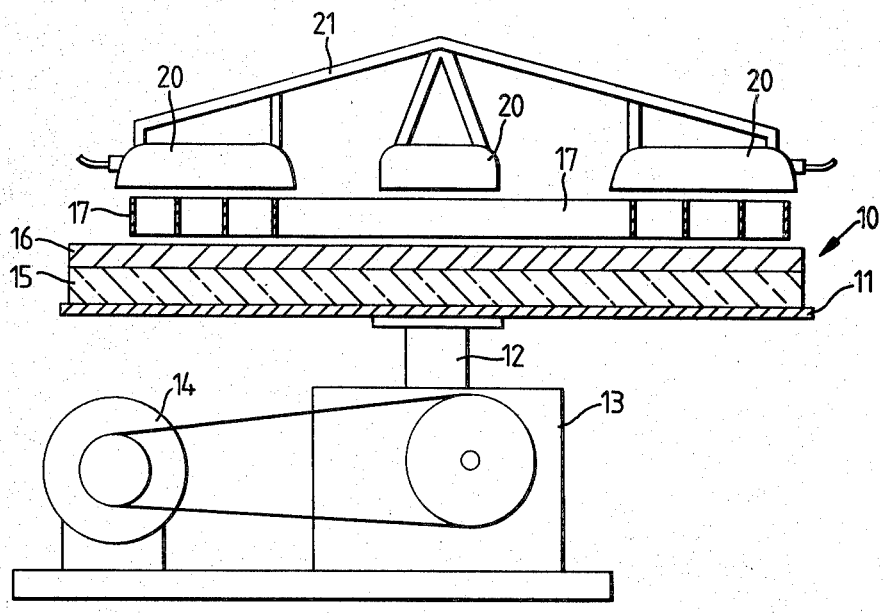
Fig.1.
Fig.4.
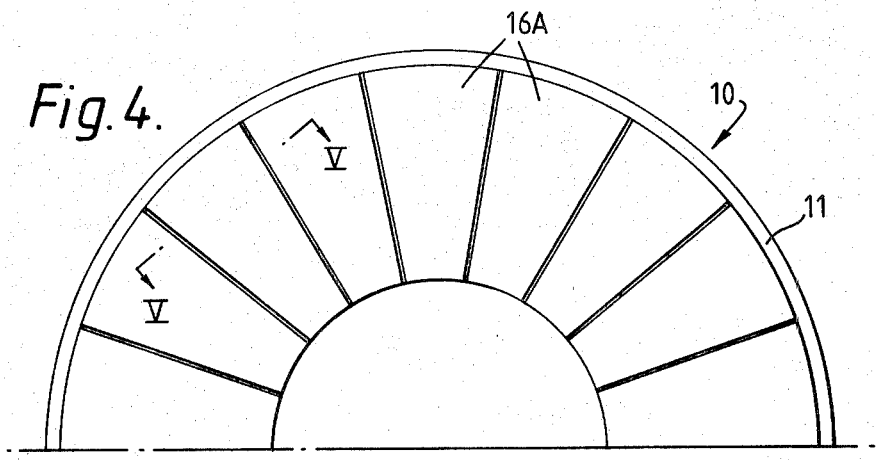
Fig.5.
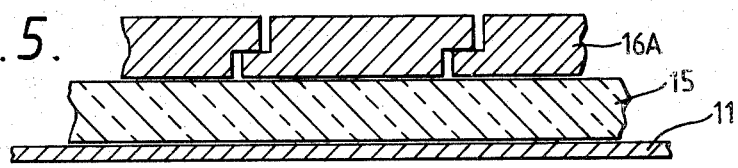

CONVEYOR FURNACE

BACKGROUND OF THE INVENTION

This invention relates to a conveyor furnace; a heating means provides a hot zone, and a continuous conveyor conveys articles through the hot zone.

Conveyor furnaces are used in the heat treatment of articles being produced on a mass production basis, for example in the annealing of pieces of copper tube in the manufacture of copper pipe fittings. The articles are introduced to the conveyor whereon they are carried through the hot zone and thereafter discharged. In this method of heat treatment, the determination of practical values for the temperature of the hot zone and the speed of the conveyor is known; and these values can be determined by trial. Known conveyor furnaces, particularly those intended for the heat treatment of relatively small articles such as the pieces of copper tube mentioned above, include a conveyor having a continuous belt of metal mesh or like flexible structure with interlinked elements. The top run of the belt carries the articles through a furnace chamber while the bottom run of the belt returns below the furnace chamber. In other known conveyor furnaces, the conveyor is a roller conveyor; alternatively the conveyor is an overhead type in which case the articles are suspended.

In general, known conveyor furnaces suffer from disadvantages caused by the fact that several load bearing mechanical components of the furnace are subjected to the conditions of the hot zone; these furnaces tend to be bulky and their thermal efficiency is relatively low.

Some of the mechanical components of the known conveyor furnaces are continuously in the hot zone and have a reduced operational life as a result. Others of such components, for example the flexible belt, enter the hot zone intermittently and therefore experience temperature fluctuation which not only reduces operational life, but also contributes to overall thermal inefficiency of the furnace. The bulkiness of the known conveyor furnaces is largely attributable to their length required for attainment of the desired heat treatment temperature.

The present invention seeks to obviate or mitigate the disadvantages outlined above.

SUMMARY OF THE INVENTION

According to the present invention, there is provided a conveyor furnace comprising heating means for providing a hot zone, means defining an input station for receiving articles to be heat treated, means defining an output station for discharging heat treated articles, means defining a carrier mounted for rotation about an upright axis and defining circular paths centered on said axis each path lying in said hot zone, and a stationary guide means extending obliquely across the said circular paths for guiding articles when the latter are on the carrier from the input station to the output station the said heating means comprising a bank of mutually independent radiant heaters, means defining a support common to said heaters and carrying said heaters, said support means together with said heaters being shiftable independently of said carrier and of said stationary guide means between a first position in which said heaters are directed towards the carrier and are disposed adjacent the stationary guide means and a second position in which the heaters are disposed clear of the stationary guide means giving access thereto.

Thus, the rotatable carrier tends to carry articles introduced thereto along circular paths while the stationary guide continuously nudges the articles, due to its obliquity with said paths, to successive paths with the result that the articles progress from the input to the output along a resultant path whose length is determined effectively by the sum of the lengths of the circular paths and a factor representing the obliquity of the guide. This gives the advantage of a compact arrangement, enables the article-engaging parts of the conveyor to remain continuously in the hot zone with a consequent improvement in thermal efficiency, and allows of a generally simplified mechanical construction.

DESCRIPTION

Embodiments of the present invention will now be described, by way of example, with reference to the accompanying drawings in which:

FIG. 1 is a diagramatic representation in sectional elevation of a conveyor furnace in accordance with the present invention;

FIG. 4 is a diagramatic plan view similar to part of FIG. 2, but showing a modification; and FIG. 5 is a sectional elevation on the line V—V in FIG. 4 and to a larger scale.

Figure 2:
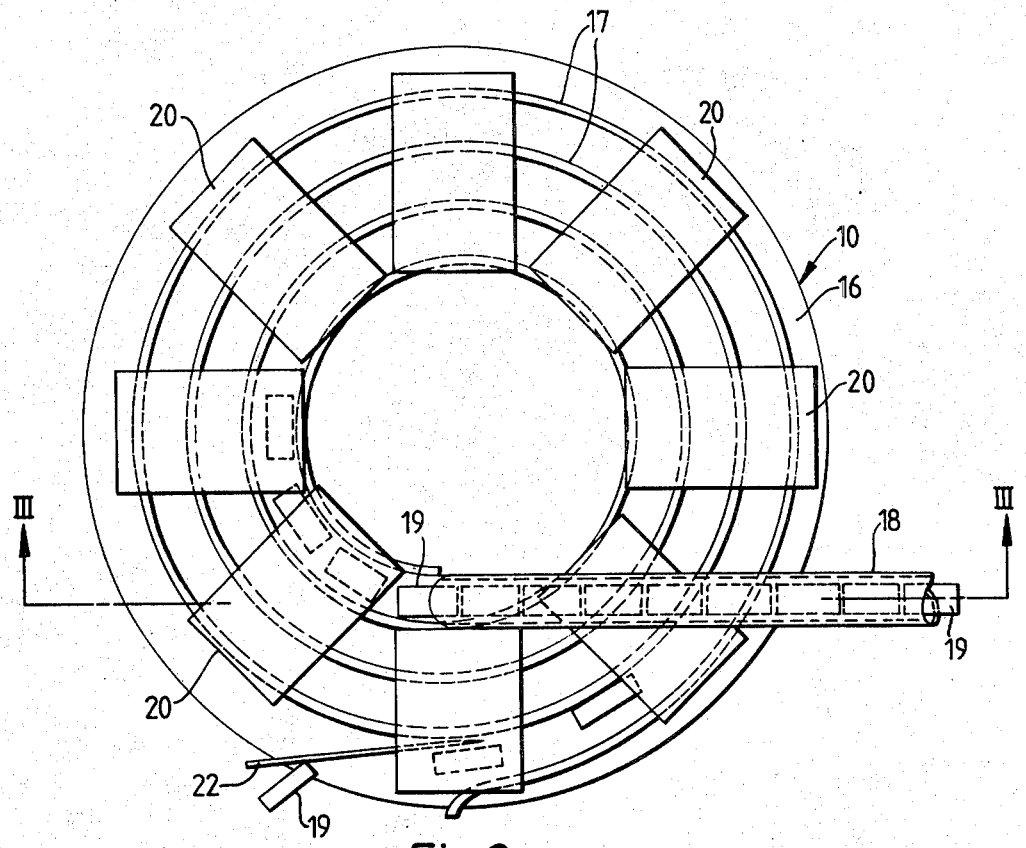
FIG. 2 is a diagramatic plan view of the apparatus of FIG. 1.
Figure 3:
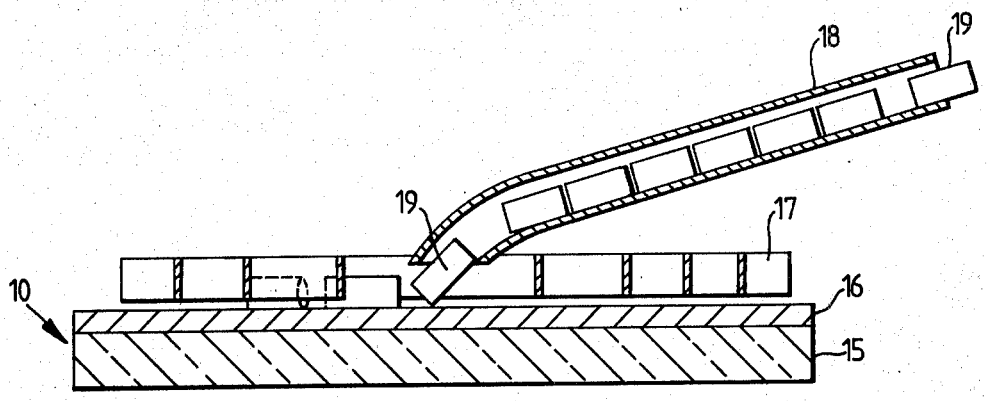
FIG. 3 is a sectional elevation on the line III—III in FIG. 2 with some parts omitted for clarity.

In FIGS. 1 to 3 of the drawings, the conveyor furnace comprises, basically, a heating means 20 for providing a hot zone therebelow, and a continuous conveyor indicated generally by reference numeral 10 for conveying articles 19 through the hot zone between an input 18 and a discharge 22.

More particularly, the conveyor 10 comprises a rotatable carrier having a circular steel support plate 11 which is mounted on a vertical drive shaft 12 rotatable by means of a variable speed drive comprising a reduction gearbox 13 and drive motor 14. The support plate 11 carries a thermally insulating layer 15 which is covered by a heat and preferably wear resistant layer 16. The drive means 13, 14 is operable to rotate the assembly 11, 15, 16 at a desired speed so that the top side of the carrier layer 16 defines circular paths about the axis of shaft 12. A guide 17 of open-coiled spiral configuration is arranged over the carrier layer 16 and is held by a fixed support (not shown) slightly spaced from the top surface of the layer 16. The centre of the spiral configuration is coincident with the axis of the shaft 12. Thus, the guide 17 which is of heat-resistant steel flat bar extends obliquely across the circular paths defined by the carrier layer 16. A feed tube 18 (FIGS. 2 and 3) is arranged with its lower end at the inner end of the guide 17 so that copper tubes 19 can be introduced to the carrier layer 16 between the turns of the guide 17.

The heating means comprises a bank of radiant heaters 20 arranged directly above the guide 17 for directing heat on to the carrier layer 16 and the paths defined thereby. The heaters 20 are gas fuelled, but other heaters may be employed capable of providing a hot zone as required. The heaters 20 are shown as being carried by a supporting frame 21. In order to facilitate the general operation and maintenance of the furnace, the bank of heaters 20 and the guide 17 are carried by respectively independent supports which may incorporate pivots to enable the heater bank and the guide to be swung independently clear of the rotatable carrier 11, 15, 16. At the outer end of the guide 17, there is fixed a deflector plate 22 for discharging the tubes 19 as hereinafter described.

The pieces of copper tube 19 are components in the production of copper pipe fittings and, typically, are of the order of 20 mm diameter and 80 mm length. The object of the heat treatment in this case is to anneal the tubes 19. The rotatable carrier is of the order of 1 meter to 1.5 meters diameter and the distance between the turns of the guide 17 is chosen to provide sufficient clearance for the passage of the tubes 19 through the guide 17 without the possibility of two of the tubes overlapping at any point within the guide which could cause jamming.

In FIGS. 4 and 5, parts corresponding with those in FIGS. 1 to 3 are given the reference numerals used in FIGS. 1 to 3. The carrier layer 16A consists of a set of segment-shaped elements made of cast iron or other heat and wear resistant material. The segment-shaped elements are laid side-by-side to form a complete carrier surface and are preferably inter-engaged through rebated side portions as shown in FIG. 5 for the purpose of promoting positional stability. The arrangement of the individual segment-shaped elements accommodates distortion arising from heating an annular shape.

The manner of operation and use of the furnace is as follows. With the heaters 20 operating, the drive means 13, 14 is operated to cause the carrier 11, 15, 16 to rotate at a speed of the order of 4 revolutions per minute. The tubes 19 are fed through the input or feed tube 18, for example by a vibratory feed (not shown), so that the tubes 19 are introduced to the inner end of the guide 17 and on to the upper surface of the carrier layer 16 or 16A. The tubes 19 are thereupon carried around the rotational axis or centre of the carrier and are simultaneously shifted relatively thereto radially with respect to the centre of the carrier by virtue of engagement with the adjacent wall of the guide 17. When the tubes 19 have completed sufficient turns to completely traverse the radial extent of the guide 17, they are discharged into a quench bath (not shown) by means of the deflector plate 22. It will be noted that whereas the tubes 19 are closely spaced or touching at the point of introduction to the guide 17, the gaps between the tubes 19 progressively increase due to the radially outwards shifting of the tubes. This radially outwards shifting of the tubes is of particular advantage in heat treating tubular or cylindrical items since they tend to roll simultaneously with the outwards shifting so that a more even heating effect is achieved.

Modifications of the furnace described above, within the scope of the present invention, include employing a 'multi-start' guide providing either twin channels for articles to be heat treated, or providing channels of mutually different widths to accommodate different sized articles; using electrical radiation heaters; employing a carrier whereof the top face is of slightly frustoconical configuration to encourage radially outward shifting of the articles, the scroll guide being of complementary configuration; and introducing a friction drive element at some point in the drive to the carrier so that in the event of a jam occurring in the scroll guide the said element would allow slippage to occur and so avoid damage to the furnace. It is also envisaged that the rotatable carrier may be of cylindrical configuration with the guide being of helical instead of spiral configuration.

I claim:

1. A conveyor furnace comprising heating means for providing a hot zone, means defining an input station for receiving articles to be heat treated, means defining an output station for discharging heat treated articles, means defining a carrier mounted for rotation about an upright axis and defining generally circular paths centered on said axis each path lying in said hot zone, and a stationary guide means extending obliquely across the said circular paths for guiding articles when the latter are on the carrier from the input station to the output station, the said heating means comprising a bank of mutually independent radiant heaters, means defining a support common to said heaters and carrying said heaters, said support means together with said heaters being shiftable independently of said carrier and of said stationary guide means between a first position in which said heaters are directed towards the carrier and are disposed adjacent the stationary guide means and a second position in which the heaters are disposed clear of the stationary guide means giving access thereto.

2. A conveyor furnace according to claim 1, wherein the carrier is of circular configuration with said circular paths on the top side thereof, and the said guide means comprises a rail of open-coiled spiral configuration.

3. A conveyor furnace according to claim 2, wherein the carrier comprises individual segment-shaped elements laid side-by-side.

4. A conveyor furnace according to claim 2, wherein the input station comprises a chute arranged with its lower end adjacent the inner end of the spiral guide.

* * * * *

UNITED STATES PATENT AND TRADEMARK OFFICE

CERTIFICATE OF CORRECTION

PATENT NO. : 4,402,668

DATED : September 6, 1983

INVENTOR(S) : Ian D. Cameron

It is certified that error appears in the above-identified patent and that said Letters Patent is hereby corrected as shown below:

Column 4, line 8, "radiation" should be --radiant--.

Signed and Sealed this

*Fifth* Day of *June 1984*

[SEAL]

*Attest:*

GERALD J. MOSSINGHOFF

*Attesting Officer*

*Commissioner of Patents and Trademarks*